United States Patent [19]

McWhorter

[11] 4,082,330

[45] Apr. 4, 1978

[54] DOOR LOCK VERSION

[76] Inventor: Delmer L. McWhorter, 929 Drever St., West Sacramento, Calif. 95691

[21] Appl. No.: 730,940

[22] Filed: Oct. 8, 1976

[51] Int. Cl.[2] ..... E05C 9/08

[52] U.S. Cl. ..... 292/218

[58] Field of Search ..... 70/61, 69, 202; 292/218, DIG. 31

[56] References Cited

U.S. PATENT DOCUMENTS

| | | | |
|---|---|---|---|
| 2,533,360 | 12/1950 | Dath | 292/218 X |
| 2,592,647 | 4/1952 | Black | 292/218 |
| 3,151,898 | 10/1964 | Olander | 292/218 X |
| 3,974,668 | 8/1976 | McWhorter | 70/61 |

*Primary Examiner*—Richard E. Moore
*Attorney, Agent, or Firm*—Blair & Brown

[57] ABSTRACT

A door lock, such as would be used on truck bodies to securely fasten the big rear doors, or which is easily opened to remove merchandise stored in the truck. A locking rod runs vertically the length of the door, with a pivotable handle attached at a reachable height from the bottom, the handle being raised to clear the lock, and then rotated a quarter to half revolution, to thereby rotate the locking rod and free it from hasps at top and bottom of the rod. A spur extends out from the handle and has a series of stepped shoulders which progressively enter the lock to secure the handle against movement when desired.

1 Claim, 12 Drawing Figures

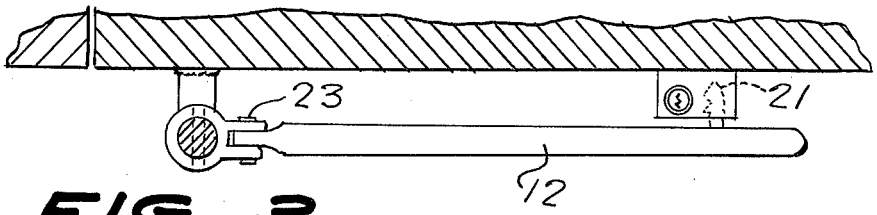
FIG. 3.
FIG. 4.
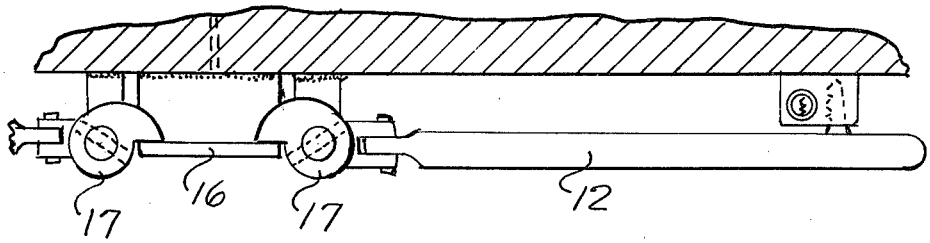
FIG. 5.
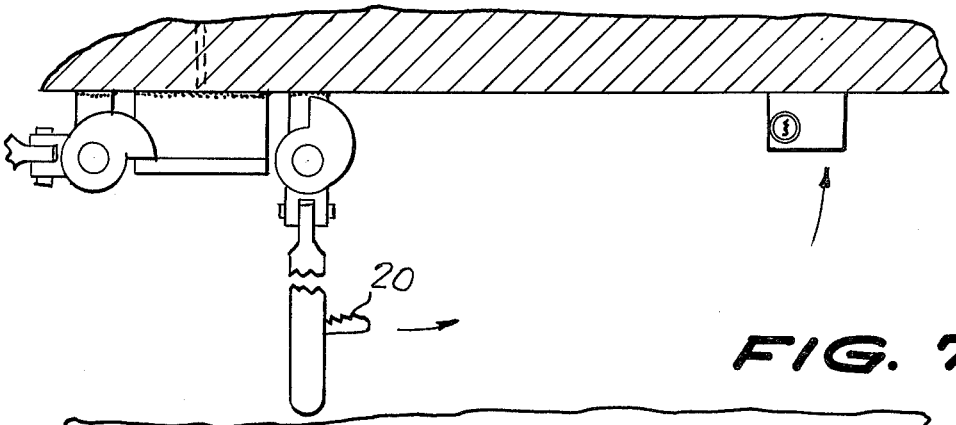
FIG. 7.
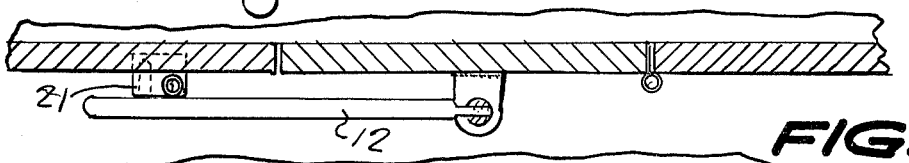
FIG. 8.
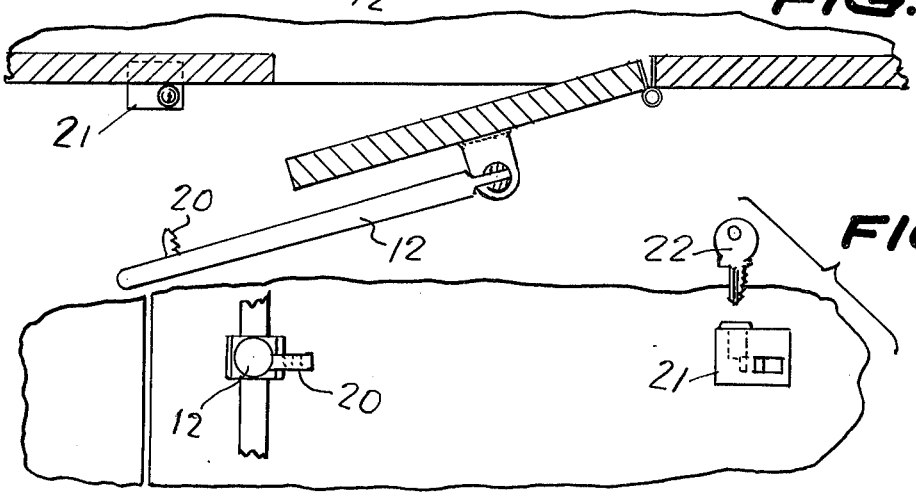
FIG. 6.

FIG. 9.
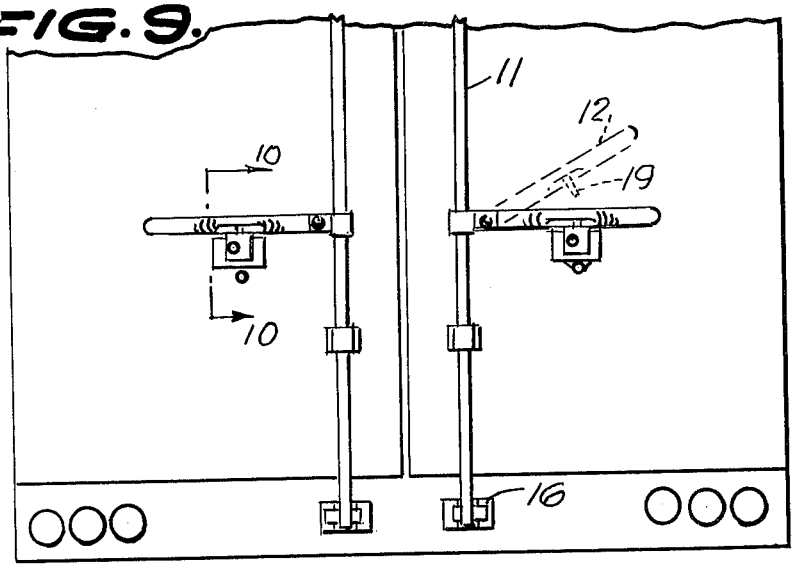
FIG. 10.
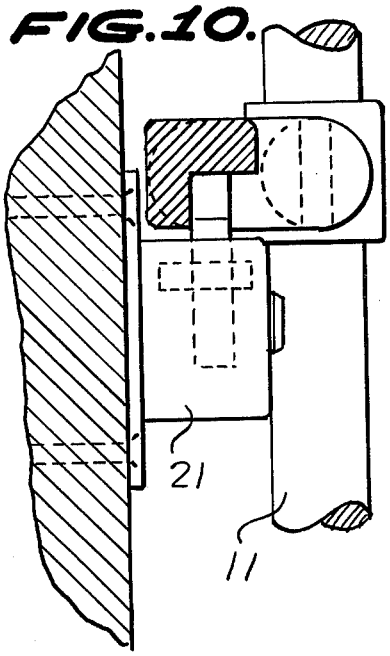
FIG. 11.
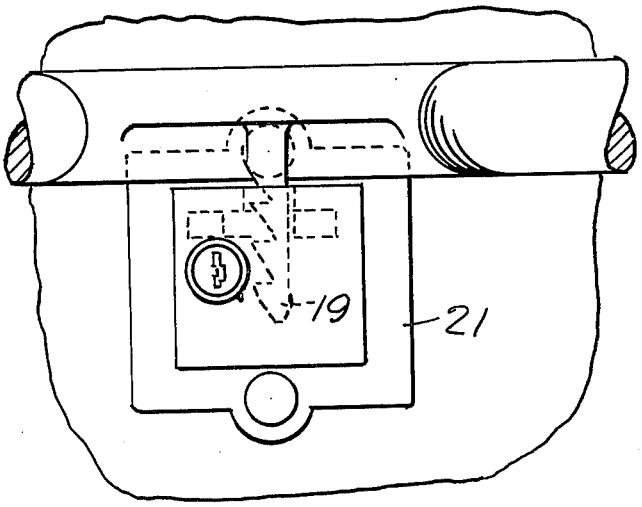
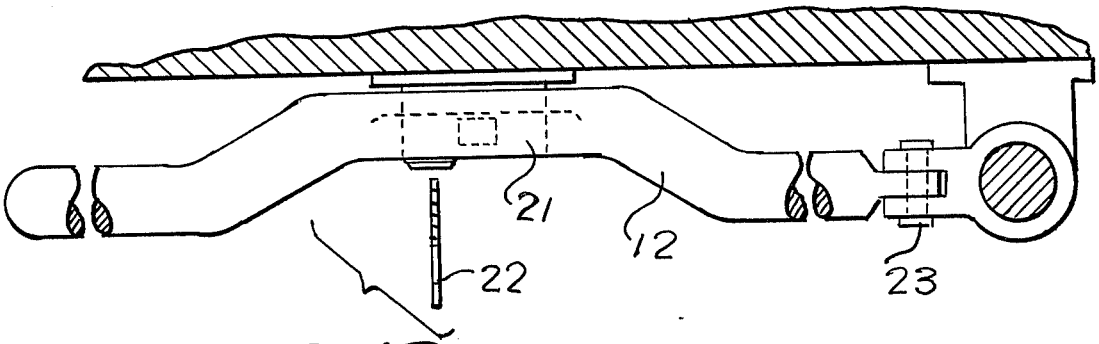
FIG. 12.

DOOR LOCK VERSION

BACKGROUND OF THE INVENTION

FIELD OF THE INVENTION

The present invention relates to a door lock for truck or van doors.

Prior locking means for truck doors have proven unsatisfactory, because a chain and regulation padlock appear to be easy prey for a professional thief. A crow bar can easily be used to pry open the doors themselves, or break the hasp and lock. As the rear doors of a large truck are some distance from the cab, this tampering can usually be performed unnoticed.

SUMMARY OF THE INVENTION

The present invention of a door lock as would be used on large truck or van doors includes an iron locking rod for each door, extending vertically the full length of the door, with its ends engaging hasps that are welded to the frame of the truck, just beyond the extremity of the door itself. Attached to the iron locking rod there is a locking handle, or lever arm, located generally in the lower half of the door height, which is used to turn the locking rod about one quarter of a revolution, or until hooks on the locking rod have been freed from the top and bottom hasps permitting the door to be pulled open. Where the locking handle joins the vertical locking rod there is a pivotal connection so that the handle may be raised to free its outer end from engagement with a key lock, and permit it to rotate the rod. The primary object of the invention is to provide a secure door lock for a truck or van door, but at the same time permit the door to be easily opened when necessary.

Other objects and advantages will become apparent in the following specification when considered in light of the attached drawings.

BRIEF DESCRIPTION OF THE DRAWINGS

FIG. 3 is a view taken along line 3—3 of FIG. 1 looking in the direction of the arrows;

FIG. 4 is a view taken along line 4—4 of FIG. 1 looking in the direction of the arrows;

FIG. 5 is a top plan view of the truck body and the two top hasps, with one hooked and one released;

FIG. 6 is a top plan view of a door with a key lock in place;

FIG. 7 is a top plan view showing a locked door with its locking handle in place and the spur on the handle inserted into the key lock;

FIG. 8 is a plan view of a door unlocked and open;

FIG. 9 is an elevation view of two truck doors that are shut and locked;

FIG. 10 is a view taken along the lines 10—10 of FIG. 9 and looking in the direction of the arrows;

FIG. 11 is a close up, sectional view of a lock, showing the stepped shoulders of the handle inserted into the lock; and FIG. 12 is a plan view of an alternate shaped handle, lock, and key.

DESCRIPTION OF THE PREFERRED EMBODIMENT

Figure 1:
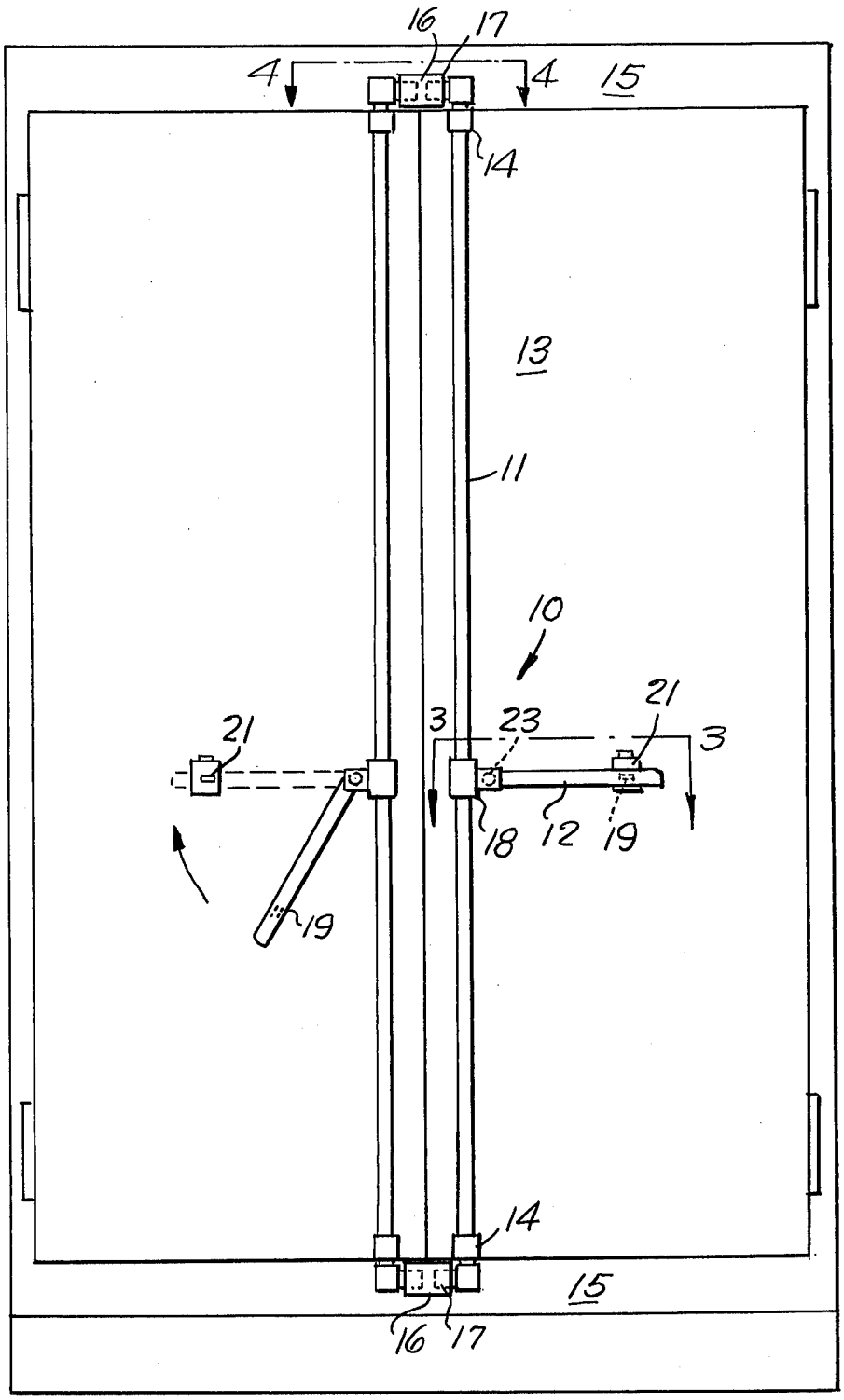
FIG. 1 is a front elevation view of truck doors with one half locked and one half ready to be opened, utilizing the invention.
Figure 2:
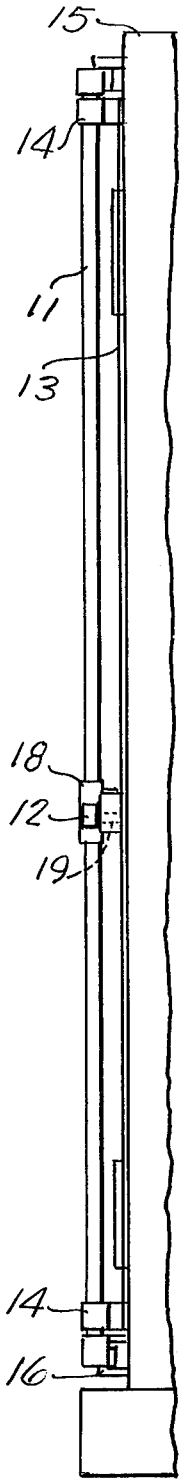
FIG. 2 is a side elevation view showing the locking rod attached to the door.

Referring now to the drawings in detail, wherein like reference characters indicate like parts throughout the several figures, the reference numeral 10 indicates generally a door lock incorporating a vertically extending locking bar 11 and a locking handle or lever arm 12.

As illustrated in FIG. 1, the locking system of the present invention is applied to secure the doors of a truck trailer, although this is just an illustrative example and the invention may be mounted on any other type door.

The locking bar 11 extends the full length of a door 13, which is to be locked, with both ends of the bar passing through a U-shaped bracket 14 mounted on the door 13 to support and guide the ends of the bar.

Close to the crack between the door 13 and its door frame 15, but securely mounted to the frame 15, there is a hasp hook 16 at both the top and the bottom of the door. The hasp-hook 16 is substantially L-shaped as may be appreciated hereinafter.

On the extreme ends of locking rod 11, and jutting out just beyond the door 13, there is a hasp 17 which cooperates with hasp-hook 16, to secure the door 13. As will be understood later, and noted in several of the figures, the hasp-hook 16, the bracket 14, and locking bar 11 set out a short distance from the flat plane of door 13. In fact they set out a distance slightly further than the length of hasp 17 so that the hasp can rotate and engage or free itself from hasp-hook 16 without striking against the fact of door frame 15.

At a point reachable by a person standing on the ground, and located just below the center line of the truck, there is a locking handle, or lever arm 12 which is used to secure or open the truck doors 13. Fastened to the vertical locking rod 11 by welding, or otherwise, there is a T-shaped fitting 18, with the cross arm of the fitting firmly attached to the rod 11, and one end of handle 12 rotatably attached to the short arm of the fitting as at 23. Near the outer end of handle 12 there is welded a spur 19, the spur 19 extending a short distance out at right angles to handle 12 and having a series of stepped shoulders 20 cut into one side of the spur.

Near the outer end of handle 12, and in alignment with the spur 19 there is a key lock arrangement 21 which is positioned to receive spur 19 and its stepped shoulders 20 to firmly and securely lock the handle 12. A standardized key 22 (FIG. 6) is used to rotate the tumblers of lock arrangement 21 and thereby release spur 19 and handle 12 so that the door may be opened.

As an alternative location for spur 19 (See FIG. 9) the spur may be moved over nearer the center of arm 12, rather than near its end, as in FIG. 1, and the arm 12 may be crooked as shown in FIG. 12. In this modification movement of the arm is somewhat different, as will be described hereinafter.

In the use and operation of the invention when it is necessary to unlock and open doors 13, key 22 is put into lock arrangement 21 and turned to release spur 19 so that it can be pulled from the lock. In pulling spur 19 from the lock, arm 12 is grasped and pulled outward, and since arm 12 and fitting bracket 18 are firmly attached to locking rod 11, this movement causes rod 11 to rotate. This rotation of rod 11 naturally turns hasp 17, about a quarter turn, until hasp 17 is now free of hasp-hook 16, and further pull on handle 12 will open door 13. Since handle 12 is pivoted, at point 23, to bracket 18, release of the handle will cause it to drop down vertically, parallel with rod 11.

To lock door 13 the procedure is just the reverse of that enumerated above. Handle 12 is grasped, raised until it is horizontal, pushed to close the door, rotated to turn rod 11 until hasp 17 is located and hooked behind latch-hook 16, and then arm 12 is pushed until spur 19 enters and is entrapped by lock arrangement 21. In the embodiments of FIGS. 9 through 12, when key 22 is operated, handle 12 is raised vertically to clear the lock (rather than horizontally), and bar 11 is rotated as before.

Having thus described the preferred embodiments of the invention it should be understood that numerous structural modifications and adaptations may be resorted to without departing from the spirit of the invention.

What is claimed is:

1. A door lock for locking two doors together at their surface of tangency comprising, a pair of vertically extending bars each fastened to one door near their surfaces of tangency, said bars having orthogonally disposed hasps, a pair of hasp hooks disposed between said poles at the top and bottom on a door frame surrounding said doors having a U-shaped configuration to receive and retain said hasps, a pair of arms each substantially medially fastened on each of said poles and pivotable about said poles to engage and disengage said hasps from said hasp hooks by rotating said poles, plural lock means on said doors to receive said arms and lock said arms to said doors so that said hasps are engaged with said hasp hooks and the doors cannot be opened.

* * * * *